US006735820B1

(12) United States Patent
Teutsch

(10) Patent No.: US 6,735,820 B1
(45) Date of Patent: May 18, 2004

(54) APPARATUS FOR CLOSING SLIDING DOORS

(75) Inventor: Marvin Teutsch, Phoenix, AZ (US)

(73) Assignee: Roltec Products, Inc., Phoenix, AZ (US)

( * ) Notice: Subject to any disclaimer, the term of this patent is extended or adjusted under 35 U.S.C. 154(b) by 0 days.

(21) Appl. No.: 10/172,044

(22) Filed: Jun. 13, 2002

(51) Int. Cl.[7] ..... E05F 1/08

(52) U.S. Cl. ..... 16/72; 16/67; 16/76; 16/61; 16/197

(58) Field of Search ..... 16/78, 76, 77, 16/72, 61, 63, 66, 67, 197; 49/404, 445, 446; 160/191, 192

(56) References Cited

U.S. PATENT DOCUMENTS 4,003,102 A * 1/1977 Hawks et al. ..... 16/72
4,301,623 A * 11/1981 Demukai ..... 49/404
4,642,845 A * 2/1987 Marshik ..... 16/194
4,760,622 A * 8/1988 Rohrman ..... 16/196
4,819,295 A * 4/1989 Kaftan ..... 16/72
4,914,780 A * 4/1990 Rogers et al. ..... 16/193
4,927,198 A * 5/1990 Fennell et al. ..... 292/306
5,251,402 A * 10/1993 Richardson et al. ..... 49/404
5,365,636 A * 11/1994 Jensen ..... 16/67
5,657,511 A * 8/1997 Lan ..... 16/51
6,167,589 B1 * 1/2001 Luedtke ..... 16/71

FOREIGN PATENT DOCUMENTS

EP 0567262 A * 10/1993

* cited by examiner

*Primary Examiner*—Chuck Y. Mah
(74) *Attorney, Agent, or Firm*—Gregory J. Nelson

(57) ABSTRACT

An automatic door closer for a sliding door. The closer has a reel with a cable extending around a pulley on the end of the rod of a return mechanism. In preferred embodiments, the return mechanism is an oil dammed gas spring or a magnetic spring. A spool rotates on a common shaft with the reel and is wound with a flat tape which is attached to the door frame. The reel, spool, return mechanism and cable are attached to the door so that application of an opening force will cause the cylinder rod to retract. Upon release, the stored energy will cause the rod to extend, rotating the reel and spool to wind the tape onto the spool applying a controlled rate closing force. The spool has a core with a greater diameter than the core of the reel so a mechanical advantage exists between the spool and reel and friction is reduced.

10 Claims, 5 Drawing Sheets

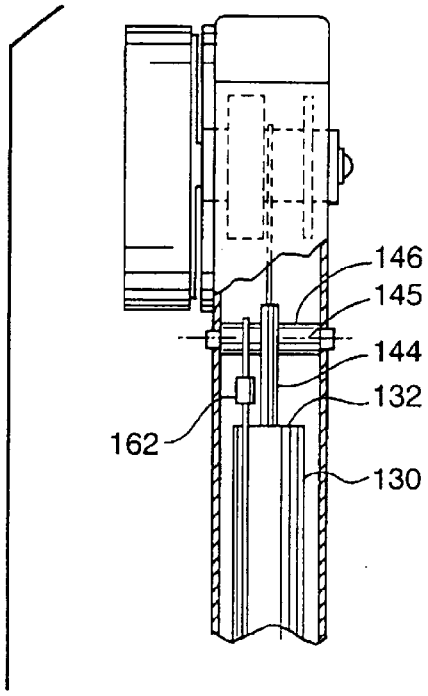
FIG. 4.
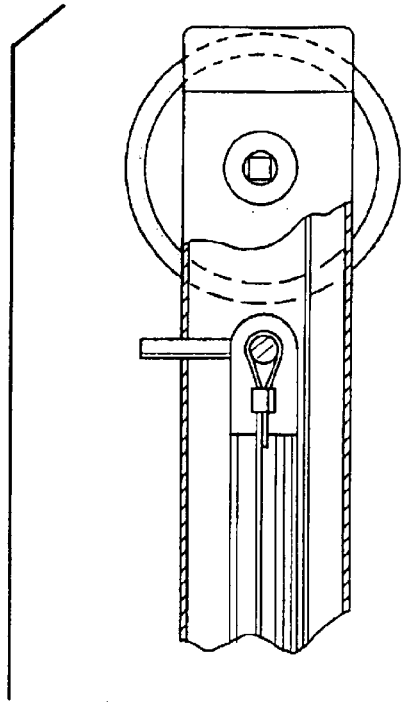
FIG. 5.
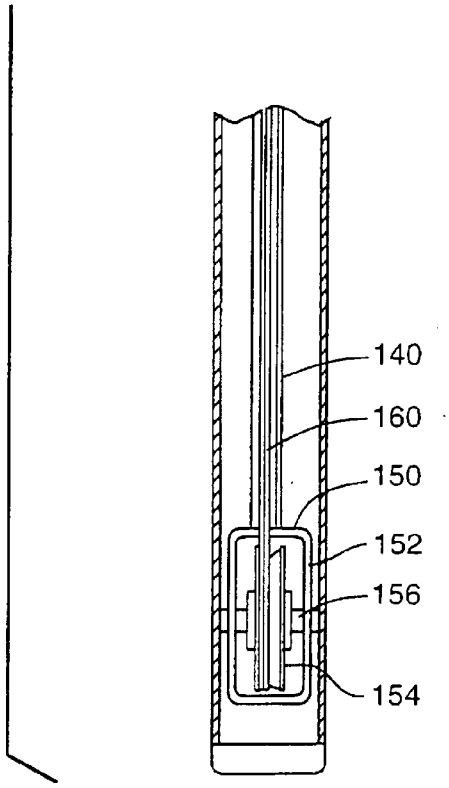
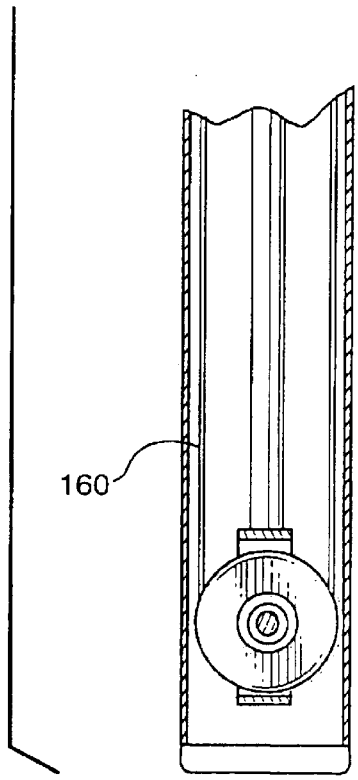

APPARATUS FOR CLOSING SLIDING DOORS

FIELD OF THE INVENTION

The present invention generally relates to a door closing apparatus and more particularly to a closer apparatus for automatically returning a sliding door to a closed position at a controlled rate.

BACKGROUND OF THE INVENTION

Sliding doors are commonly used in both residential and commercial installations. Generally these doors are constructed having a rectangular frame which retains one or more glass panels. A common sliding door of this type is termed an "Arcadia" door and has a fixed section adjacent the sliding section which fixed section generally including a large glass panel. The sliding panel is supported along the lower edge of the door on rollers movable in a track. This type door may also have hangers with rollers which move in a track along the upper horizontal edge of the door. Doors of this type are quite heavy, particularly those having steel frames, and, as such, require considerable manual effort to open and close the doors. Accordingly, it is not uncommon for individuals, particularly children, to open the door when entering or exiting and leave the door in the open position. This results in a considerable waste of energy as during summer cool air is allowed to escape through the opening and during winter months heated air within the structure will escape.

Additional inconveniences, as a result of a door left open, includes entry of insects, dirt and dust. Another problem that results from doors of this type being inadvertently left open is that the opening may present a safety hazard, as a small toddler or child may crawl or walk through the opening and wander away and encounter hazards such as backward swimming pools or street traffic.

As a result, efforts have been made to provide closing mechanisms for sliding doors of this general type. One such approach, which has achieved considerable success, is the present inventor's apparatus for closing sliding doors as disclosed in U.S. Pat. No. 5,365,636 and sold under the trademark The Klozit. Briefly described, The Klozit device, is an apparatus for returning a sliding door from an open position to a closed position which includes a compressible spring mechanism. The compressible spring mechanism exerts a biasing force tending to extend the rod of the spring mechanism. A cable is secured at a first end to the sliding door and is secured its opposing end to the fixed door frame. The first end of the cable is secured in a fixed position relative one of the two ends of the spring mechanism. The cable extends about a first and second pulley. As the door is opened, tension is applied to the cable and the first and second pulleys exert a compressive force to shorten the length of the compressible spring mechanism. When the door is released, the compressible spring mechanism returns to its extended length causing the door to return towards its closed position. The Klozit device has achieved commercial success and is effective for its intended purpose and it represents a substantial improvement over prior art devices. However, the Klozit device utilizes a series of pulleys which inherently impose frictional resistance. Further, use of multiple pulleys increases the mechanical complexity of the device.

Accordingly, the present invention provides an improved door closing apparatus (termed a "closer") for automatically closing a sliding door which closer device is efficient, compact, unobtrusive, and operates with reduced frictional forces so that the manual opening force required is reduced while still providing adequate closing force.

It is a primary object of the present invention to provide a sliding door closing system which automatically closes a sliding door at a safe, controlled speed.

It is yet another object of the present invention to provide a sliding door closing apparatus which is inexpensive to manufacture and can easily be installed both on new and existing doors.

It is an object of the present invention to provide a closer for sliding doors which is "armed" as the user applies a manual opening force and which operates with minimal frictional loss.

It still another object of the present invention to provide automatic sliding door closing system which cushions the door as the door closes approaching the door jamb, thus reducing the possibility of injury to persons, as well as to pets.

BRIEF SUMMARY OF THE INVENTION

Briefly, the present invention relates to a closer apparatus for returning a sliding door to a closed position. A compressible spring has a rod with an extended and retracted position. A cable reel is rotatably supported in a housing and has an attached cable which extends around a pulley on the end of the rod. The opposite end of the cable is fixed. As the door is opened, the cable reel is rotated and tension is applied to the cable which will force the rod toward its retracted position. When the door is released, the compressible spring will return the rod to its extended length.

A spool is rotatable with the reel and mounted on a common shaft. The spool and reel are wound in opposite directions. The spool has a core having a radius which is greater than the radius of the core of the reel so a mechanical advantage is achieved. The line on the spool preferably is a strong flat tape. The spool and reel assembly, spring and pulley are within the housing which housing is securable to a door frame member. The free end of the spool line is affixed to the door frame preferably along the upper horizontal section.

The compressible spring member may be a simple coil spring or a cylinder with a piston and rod and having a compressible coil spring in the head end chamber. However, it is preferred the compressible spring be a gas spring of the type containing a pressurized gas which urges or biases a piston and attached rod to the extended position or a positioning apparatus including a set of magnets that exert a magnetic force to urge a rod or shaft in one direction.

When a manual opening force is applied to the door, the rod of the compressible spring will be retracted as the spool will rotate in a direction to pay out line and rotation will cause the cable on the reel to be wound onto the reel. When the opening force is released, the compressible spring will urge the rod and pulley on the end of the rod to an extended position rotating the reel in the opposite direction and simultaneously causing the line attached to the spool to rewind exerting a closing force. As the door approaches the jamb, the compressible spring has a dampening feature to slow the return of the door.

The apparatus can be retrofit to existing doors or incorporated in a door assembly as an item of original manufacture.

BRIEF DESCRIPTION OF THE DRAWINGS

The above and other objects and advantages of the present invention will become more apparent from the following description, claims and drawings in which:

FIG. 4 is a longitudinal cross-sectional view of the closer apparatus;

FIG. 5 is a rear view of the apparatus partly broken away;

DETAILED DESCRIPTION OF THE DRAWINGS

Figure 2:
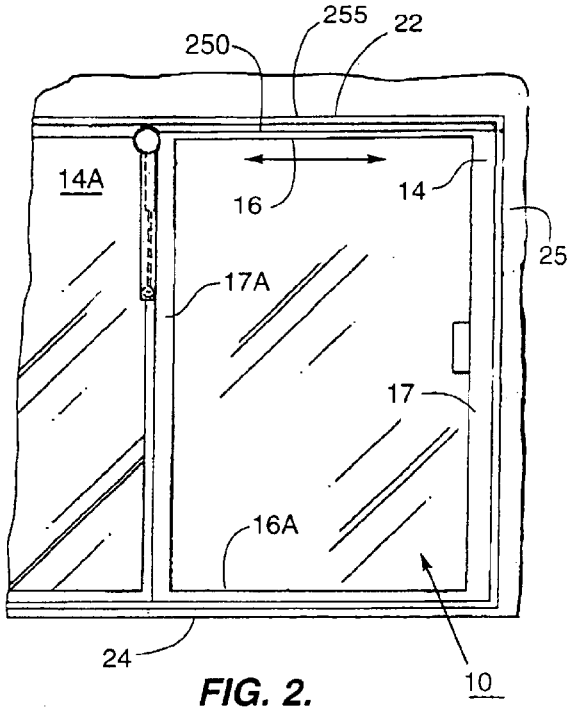
FIG. 2 is a front view of a representative sliding glass door and door frame showing the door closer apparatus of the present invention installed thereon.

Turning now to the drawings, the closer apparatus 100 of the present invention is shown in FIG. 2 in conjunction with a conventional sliding door 10 which is representative of the type of installation to which the system may be applied. The sliding door 10 is shown having a slidable panel or section 14 having a frame with opposite horizontal sections 16, 16A and vertical frame sections 17, 17A, containing a glass pane. The sliding door 10 is mounted for sliding movement along upper horizontal track 22 and lower, horizontal track 24. Typically, the door will be supported on rollers, not shown, engaging the lower track. In some installations, the upper door frame section 16 may also be supported on hangers having rollers and which roll along the upper horizontal track.

In the closed position, the vertical edge 17 of the door will engage or abut the vertical section of the jamb 25 of the frame. To open the door, the door is moved manually to the left, as shown in FIG. 2, causing the door to roll so that it overlaps all or a portion of the fixed panel 14A. As the door is moved leftward, an opening for entry or exiting is defined between the jamb 25 and the right edge of frame section 17 of the sliding door. It is not uncommon for doors of this type to be inadvertently left in the open position wasting energy and creating safety hazards.

Accordingly, the present invention provides an improved closer apparatus for automatically returning sliding doors of the general type described to a closed position at a controlled, safe rate. The apparatus is actuated or armed by the manual movement of the door to the open position which stores energy in a return mechanism. Once the door has been released by the individual applying the opening force, the closer will operate to return the door at a safe, controlled rate to the closed position.

As seen in the drawings, the closer 100 includes an elongate tubular housing 102 having a rear wall 104, opposite sidewalls 106, 108 and a front wall 110. The tubular housing, preferably an extruded section of a material such as aluminum, may be of various sizes, but typically for most installations is approximately 1½ inches wide, 1 inch deep and approximately 32 inches long.

A return mechanism 120 extends axially within the interior of the tubular housing and operates to store energy to provide a closing force once the door is opened. The mechanism may be a coil-spring, a cylinder having a piston and rod with a coil spring in the head end chamber but is preferably either a gas spring of the type commercially available from AVM Corporation, as shown in the schematic in FIG. 6 or a magnetic closer such as that available under the designation Magna Motor.

Figure 6:
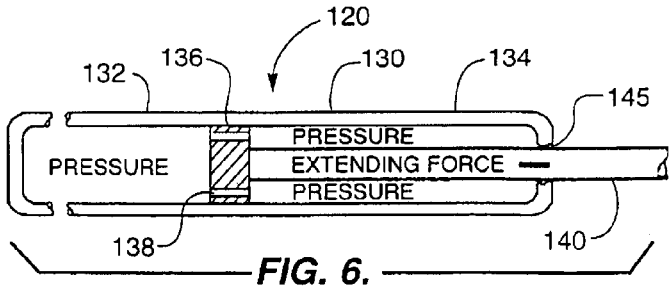
FIG. 6 is a schematic diagram of the gas spring.

As seen in FIG. 6 in one embodiment, the return mechanism is shown as a gas spring which has a cylindrical housing 130 having a head end 132 and a rod end 134. A piston 136 is reciprocal within the cylinder chamber and defines an orifice 138 extending between the head end chamber and the rod end chamber. A rod 140 extends from the piston through the rod end at an appropriate seal 145. Pressurized gas within the cylinder will exert an extending force which urges the piston and rod toward the extended position. Application of a force to retract the rod 140 will compress the gas and, when released, will cause the rod to extend. The orifice 138 meters flow of gas and oil as the piston and rod move outwardly. Gas springs of this type may incorporate a dampening feature, usually an oil cushion, that will slow the final extension which will slow the door as it reaches the jamb.

The return mechanism is mounted by a mounting flange 144 extending from the head end and secured by an anchor pin 146 extending transversely between the sidewalls of the housing through an aperture 148 in the end of the flange. The cylinder rod extends longitudinally within the housing. A rectangular cage 150, having spaced-apart side walls 152, is attached to the lower end. A pulley 154 is within the cage and rotatively supported on an axle 156 extending transversely between the opposite sidewalls of the cage.

As seen in FIG. 5, the diameter of the pulley is slightly less than the transverse dimension of the housing so that as the rod 140 reciprocates within the housing, the cage and pulley on the end of the rod are guided preventing the pulley from binding in the housing. A cable 160, such as a 0.044" diameter steel cable, is anchored at one end to the anchor pin 146 in the housing. The cable is secured by looping the cable over the anchor pin and securing it with a clip 162 to form an eye through which the anchor pin 146 extends. The cable 160 extends downwardly around the groove in the pulley 154 at the lower end of the rod and returns extending upwardly to cable reel 176 rotatively supported at the upper end of the housing.

Figure 3:
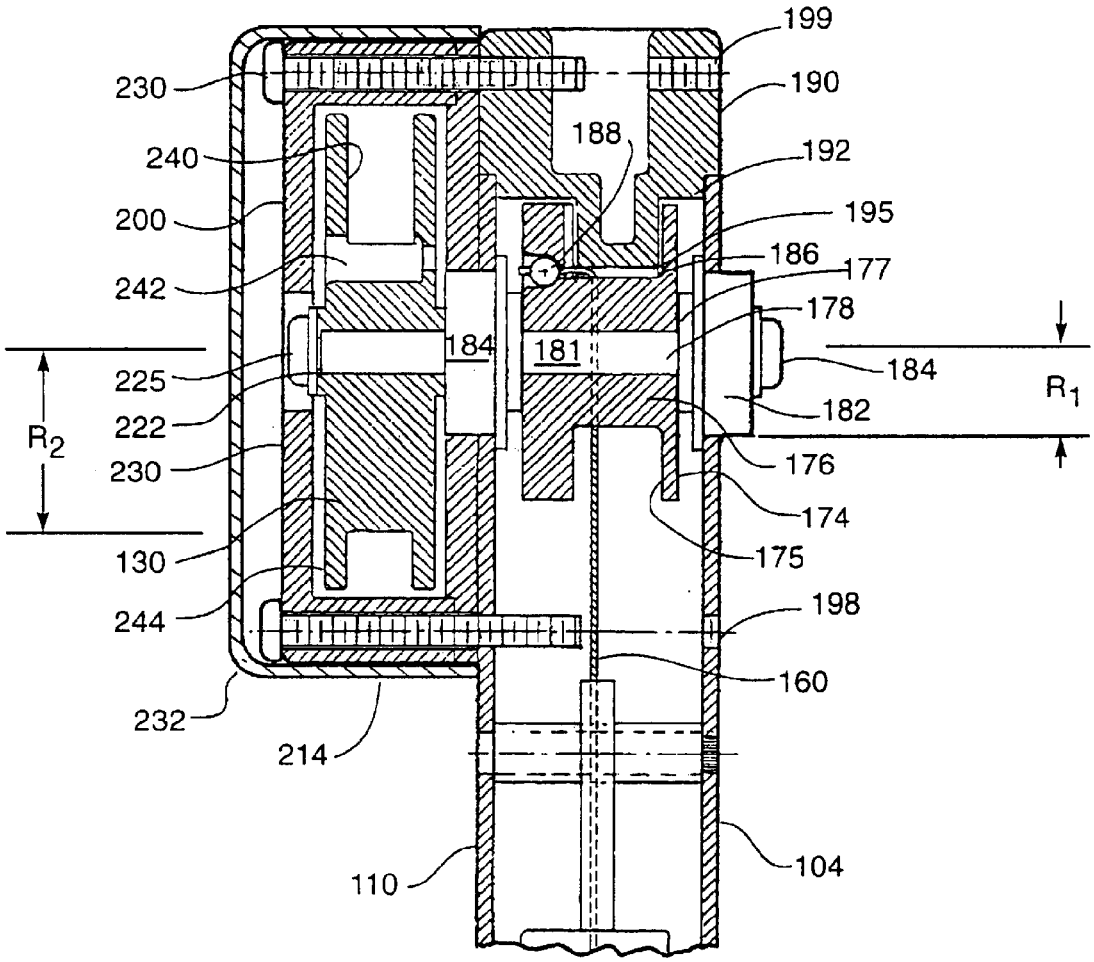
FIG. 3 is an enlarged cross-sectional view taken along line 3—3 of FIG. 1.

The cable reel 176 is best seen in FIG. 3 and has opposite side walls 174 which define annular cable receiving groove 175 which is shown as being substantially square in cross section. The cylindrical core of the reel has a radius R1. A bore 177 extends transversely through the reel and is square in cross section. Shaft 178 extends transversely through the bore of the reel and projects past the opposite sidewall of the housing to support spool 180, as will be explained hereafter. The shaft 178 is circular but has square section 181 that is received within the bore of the reel so that the shaft and reel rotate together. The shaft 178 is supported in a bearing assembly 182 at an opening in rear wall 104 of the housing. A second bearing assembly 184 secures shaft 178 at housing sidewall 110. The reel may be any suitable material but preferably is a light weight metal such as aluminum or may be a durable plastic material such as nylon, Delrin or the like.

The cable 160 extending upward from pulley 154 terminates at an end which extends through transverse bore 186 in the reel. The cable end is secured by a bead 188 applied to the end of the cable and received within a recess 189 of the sidewall of the pulley. The cable 160, as it winds about the reel, will cause the cylinder rod 140 to retract moving the piston 136 within the cylinder toward the head end of the cylinder applying a compressive force to the pressurized gas within the head end chamber 132.

A cap 190 is pressed into the upper open end of the tubular housing and has a projection 192 that extends to the annular area within the reel. A clearance space 195 is defined between the projection and the core of the reel for cable management.

Figure 1:
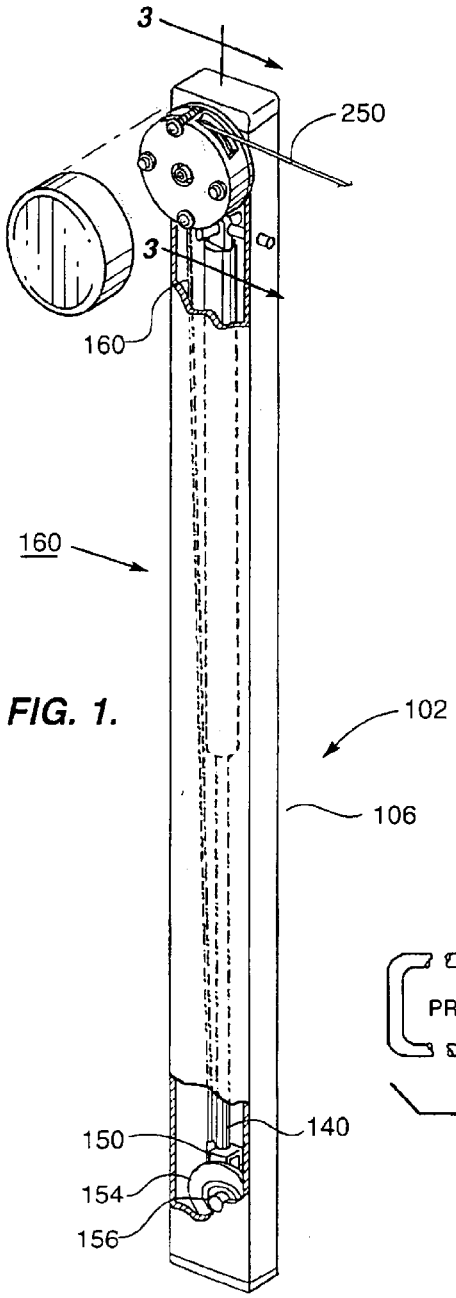
FIG. 1 is a perspective view of the sliding door closing apparatus in accordance with a preferred embodiment of the present invention.

Cap 190 defines opposed threaded bores 199. Similarly, the housing defines opposed threaded bores 198. These threaded bores provide locations for attachment of the spool housing 200 which, as seen in FIGS. 1 and 3, is shown attached to housing front wall 110. Openings are defined in the housing sidewalls 104, 110 concentric with the axis of the shaft into which round bearing assemblies 182, 184 may be pressed to support shaft 178 for rotation.

Spool 180 is enclosed in generally circular housing 200 having an outer wall 210 and a circumferential sidewall 214. The spool has a central bore 222 which is square in cross section to receive the distal end of the shaft 178 projecting from the housing. The section of shaft 178 within bore 222 is also square in cross section so that the reel 176 and spool 180 rotate together. The spool 180 is held on shaft 178 by a screw and washer assembly 225 inserted at a central location in the outer wall of the housing. The housing 200 is secured to cap 190 and to the tubular housing 102 by machine screws 230, 232 extending in spaced-apart bores 198, 199 as described previously.

Figure 7:
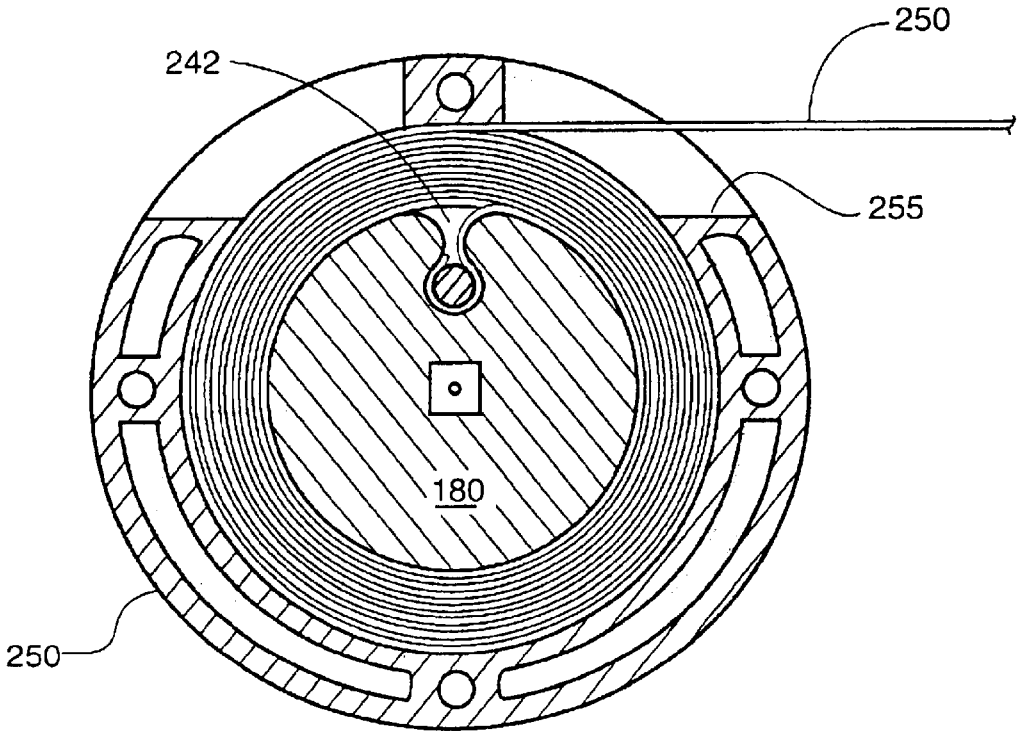
FIG. 7 is a cross-sectional view of the spool taken along line 7—7 of FIG. 3.

The spool 180 defines an annular groove 240 having a generally square cross section and sidewalls 244. A slot 242 extends from the base of the groove to a transverse bore in the sidewall of the spool so that line 250 wound about the spool may be anchored at this location as best seen in FIG. 7. The housing 200 defines an opening 255 which allows the line to extend from the housing so it can be attached to the door frame as seen in FIG. 2.

Note that the radius R2 of the spool is substantially greater than the radius R1 of the reel. Typically, the ratio of the two is about 2½ to 1 so that a substantial mechanical advantage is developed between the reel and spool. It will be understood that the line on the spool and the cable on the reel are reversely wound so that as one takes in line or cable, the line or cable on the other is payed out. As will become more apparent hereafter, the opening force applied to the door will impart rotation to the spool and store energy which will, in turn, impart rotation to the reel. Since the radius of the spool is the greater, essentially a "frictionless" lever is established with the force applied to the spool being increased or multiplied when applied to the reel.

The spool is wound with one or a plurality of wraps of a flexible line 250, preferably a thin, flat tape, of a strong material such as Mylar. It will be apparent that if more wraps are applied about the core of the spool, the effective mechanical advantage between the spool and reel can be increased as the relationship between the two radii R1, R2 will change. Tests have indicated that, for best results, the relationship between R1 and R2 is selected to provide an overall mechanical advantage between 4.8 to 6.0.

It will also be appreciated that the spool housing can be mounted on either side of the cylinder housing for right or left operation. This can be easily accomplished by removing the machine mounting screws 230, 232 and then removing the spool housing and sliding the center shaft through the bearings. The shaft assembly is reversed so that the shaft extends for example, from the side 104 of the housing as shown in FIG. 3. The spool housing can then be attached to side 104 using the same bearings, washers and screws. This accommodates convenient installation on either right or left hand opening doors.

The closer apparatus is installed by securing the housing to the vertical door frame 17A near its upper end, as seen in FIG. 2. The housing can be secured by suitable means such as sheet metal screws or other fasteners extending into the door frame which is generally extruded aluminum sections. The spool line 250 is extended from the door pulley through the housing opening horizontally along the upper door frame and is anchored by a pin or fastener 256 secured to the upper, horizontal section 22 of the door frame. Note that the point of attachment typically is located about 6 inches from the vertical door frame which is an advantage over my prior device which, as seen in the '636 patent, required-attachment by extending a cable across the full width and securing it at the doorjamb.

If desired for a particular installation, the spool can be prepared by extending a pre-number of wraps of line 250 about the spool to achieve the desired mechanical leverage or advantage relationship between the door spool and the cable reel to provide the desired opening and closing force. This is usually determined by the trial and error and personal preference of the user. Once this has been determined, the end of the line is secured. It is noted that use of a flat tape, particular of a material such as Mylar, is advantageous as the material tends to stay flat as it winds and unwinds. Further, a tape of synthetic material such as Mylar, not only is strong but is light weight, visually unobtrusive and will resist binding and kinking.

In operation, an individual will open the sliding door by moving the sliding door 14 to the left, as shown in FIG. 2. As the sliding door moves leftward, a rotational force will be applied to the spool 180 as a result of the end of the line 250 being anchored. As the spool rotates, rotation will also be imparted to the reel 176 and shaft 178 in a direction to cause cable 160 to be wound about the reel. The winding force is multiplied due to the differential existing between radii R1 and R2. The reel is wound in a direction so that as the reel rotates, cable 160 extending around the pulley 154 on the lower end of the rod will wind onto the reel 176 causing the spring rod to retract. As the rod 140 retracts, gas in the head end of the cylinder is compressed. Further, the movement of the piston 136 towards the head end of spring gas cylinder 130 will compress the spring within the head end of the cylinder. This continues until either the door is fully opened or the user ceases to apply further opening movement.

When the user releases the sliding door, the compressed gas will apply a force to the piston 136 causing the rod 140 to extend. As the cylinder rod extends, the reel 176 will be caused to rotate imparting rotation to the door spool in a direction to wind the line 250 onto the spool. As the line is wound onto the spool, the door will be drawn or pulled to a closed position. As the door approaches a closed position, the orifice 138 in the piston meters flow of gas and oil through the piston to provide a controlled closing rate. As the door approaches the door jamb, the oil cushion within the spring slows the advance of the door even further to prevent injury as may occur when somebody inadvertently places a hand or finger in the door opening.

The above invention has been shown as being mounted exteriorly of a door frame member and it will be appreciated that the apparatus can be incorporated within the door frame when the door is manufactured, such as within vertical member 17 or 17A, so as to place much of the system out of sight. However, the device is relatively small and compact and, even with an exterior mounting as shown in FIG. 2, would not generally be aesthetically objectionable.

EXAMPLE

An apparatus, as described above, was fabricated and tested. The system was installed on a patio door of the Arcadia door type measuring approximately 48" by 78", and the door weighing approximately 96 pounds. The dimensions of the components of the system are as follows:

Return mechanism—gas spring by AVM Corporation, Model No. GS35-5. Spool and reel were injection molded acetal plastic. Reel mean diameter (0.625+0.044)=0.669; spool mean diameter 1.600 to 2.000; tape 0.010 thick×0.25 wide Mylar (polyester).

The door was subject to repeated testing and it was found that an opening force of only approximately 9 pounds would generate as a closing force of 6 to 7 pounds. Further, the system operated quietly. Rapid, manual movement of the door would cause the Mylar tape to slacken a bit, however, binding did not occur. The tape would recover quickly and remain flattened when winding.

Figure 8:
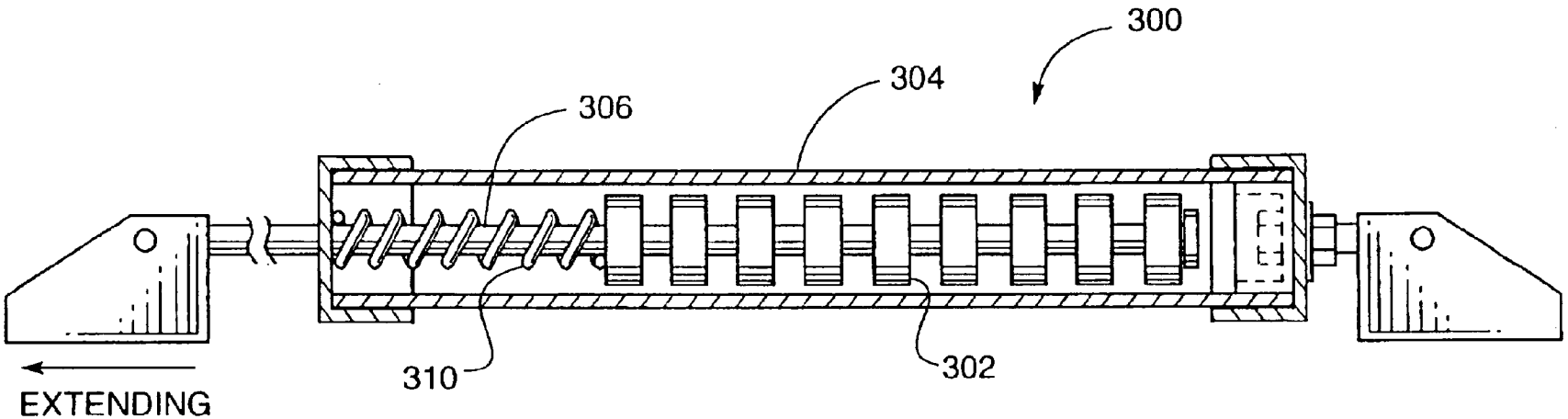
FIG. 8 is a cross-sectional view illustrating an alternate form of the return mechanism.

FIG. 8 is a cross-sectional view illustrating an alternate form of the return mechanism designated by the numeral 300. The return mechanism 300 utilizes a series of magnets 302 within a cylindrical housing 304 on a rod 306. The magnets are arranged in repulsion configuration so that when the opening force is applied the rod will retract and, upon release of the opening force, the rod will be caused to extend due to the magnetic repulsion. This type of closer mechanism is described in detail in U.S. Pat. No. 6,167,589 which description is incorporated by reference herein. Mechanisms of this type are sold under the designation Magna Motor and are available from Magna Motor, Inc., Cadott, Wis.

To provide a dampening effect, a coil spring 310 may be provided within the cylinder which is compressed as the rod approaches the end of its travel upon extension.

The magnetic type return mechanism may be utilized in place of the gas spring or other mechanical return mechanisms as described above. The remainder of the system, including the pulley, spool, reel, cable and line are as has been described.

From the foregoing, it will be appreciated that the present invention provides a compact, reliable and mechanically efficient closer device. While the closer has been described with particular reference to sliding doors, it will be appreciated that the apparatus may be used for returning a variety of members to a desired position or condition. Examples are doors, windows, covers and similar items which slide, roll or are hinged or pivot. The system operates to close a door at a controlled safe speed. The system is versatile and can be mounted on doors opening either in the right hand or left hand direction. Further, the system can be installed as an aftermarket or retrofit item on the exterior of a section of the door or may be manufactured as original equipment item of a manufacture incorporated into a door component.

It will be obvious to those skilled in the art to make various changes, alterations and modifications to the invention described herein without departing from the spirit and scope of the invention as set forth in the appended claims. To the extent such changes, alterations and modifications do not depart from the spirit and scope of the appended claims, they are intended to be encompassed therein.

I claim:

1. A closer for returning a door slidable within a frame from an open position to a closed position with the door abutting a jamb, said closer comprising:

(a) a spool having a core with a first substantially uniform radius;

(b) a reel having a core with a second substantially uniform radius less than the said first radius, said reel and spool being mounted on a common axis for rotation;

(c) a line secured to said spool at one end and being attachable to said door frame at said second end;

(d) return means having opposite first and second ends and having a first extended length and a second retracted length when a retracting force is applied thereto, said return means being fixed at said first end and exerting a biasing force urging the return means to its first extended length;

(e) a pulley on the second end of said return means; and (f) a cable having a first end fixed relative to said return means and extending around said pulley having its second end secured to said reel whereby opening of the said door applies a force to said return means to cause said return means to move from the said first extended length toward the second retracted length and whereby release of the door permits said return means to return toward its extended length imparting rotation to both said reel and spool thereby applying a force sliding the door in a direction toward its closed position.

2. The closer of claim 1 wherein said line is a flat tape.

3. The closer of claim 1 wherein said return means is a gas cylinder having a reciprocable rod and piston.

4. The closer of claim 1 wherein said return means comprises at least two magnets coupled to a shaft within a housing in relation to one another to apply a repelling force to extend the return means when the return means is retracted.

5. The closer of claim 1 wherein the ratio of the radius of the spool to the radius to the reel is approximately 2½:1.

6. The closer of claim 5 wherein said pulley is within a cage reciprocally guided in said housing.

7. The closer of claim 1 wherein said return means and pulley are within a housing.

8. The closer of claim 7 wherein said reel is in said housing and said spool is mounted exteriorly of the housing on a common shaft.

9. The closer of claim 7 wherein said reel cable and spool line are reversibly wound on said reel and spool so that as one is unwound the other is wound and vice versa.

10. The closer of claim 1 further including dampening means for slowing the closing of the door as it approaches a closed condition.

* * * * *